United States Patent [19]

Stoll et al.

[11] Patent Number: 4,728,940

[45] Date of Patent: Mar. 1, 1988

[54] PRESSURE-LOSS OVER TEMPERATURE SENSOR

[76] Inventors: Kurt Stoll, Lenzhalde 72, 7300 Esslingen, Fed. Rep. of Germany; A. C. Ferf-Jentink, Maasdal 63, NL-2904 CP Capelle a/d IJssel, Netherlands

[21] Appl. No.: 831,150

[22] Filed: Feb. 19, 1986

[30] Foreign Application Priority Data

Feb. 22, 1985 [DE] Fed. Rep. of Germany ..... 3506152

[51] Int. Cl.[4] ..... G08B 17/04

[52] U.S. Cl. ..... 340/591

[58] Field of Search ..... 340/591

[56] References Cited

U.S. PATENT DOCUMENTS 3,014,206 12/1961 Slavin ..... 340/591

4,055,844 10/1977 Hornbostel, Jr. ..... 340/591

*Primary Examiner*—Glen R. Swann, III

*Attorney, Agent, or Firm*—McGlew and Tuttle

[57] ABSTRACT

A pneumatic temperature sensitive system has a hollow detector member laid in a loop for instance in the room. The detector member is pressurized so that when the critical temperature is reached the detector member bursts and its interior space is depressurized. The detector member is connected with a pressure sensor to produce an electrical or other signal when the pressure falls so that further equipment may be activated.

20 Claims, 10 Drawing Figures

PRESSURE-LOSS OVER TEMPERATURE SENSOR

BACKGROUND OF THE INVENTION

The invention relates to surveillance or alarm systems and more especially to such a system comprising a pneumatic circuit serving to monitor the temperature of a component or of a room and to provide at least one output signal when the component or the room reaches a certain temperature.

SUMMARY OF THE INVENTION

One object of the present invention is to device such a system which has a simple and compact structure.

A further object of the invention is to provide such a system which utilizes sturdy components so that the system as a whole has a greatly enhanced reliability.

In order to achieve these or other aims appearing in the course of the present specification, the system of the invention comprises a hollow detector member placed in the vicinity of the component or room, whose temperature is to be monitored, containing a fluid under a gauge pressure. The hollow member is adapted to open when a critical temperature of the component or of the room is reached so that the hollow within the detector member is connected with the surroundings, and a sensor is connected with the said hollow of the detector member so as to respond to opening of the detector member and the ensuing fall in fluid pressure therein and to produce a signal capable of being processed.

One advantage of the invention is that it provides a reliably operating device making it possible for a temperature to be exactly ascertained or detected. Useful fields of application of the device are more especially in connection with fire prevention; the device simply react to an increase in temperature as caused for example by a fire and when a certain temperature threshold is exceeded may trip an alarm or an automatic extinguishing installation. The detector member may for instance be in the form of a solid hollow member which at one point has an orifice covered by a diaphragm which is destroyed when a given temperature is reached. It would furthermore be conceivable to have valve arrangements for closing the orifice, as for example valves operated by bimetallic elements so that the system of the invention may be used repeatedly without having to replace damaged parts. Owing to its simple design, the device of the invention is furthermore economical in price and there is the advantage that the system may be integrated in already existing surveillance and alarm systems. Another advantage is that the novel system may be easily modified and adaptation for different sizes of room or component may be simply undertaken by making suitable changes in the form of the detector member.

In accordance with one feature of the invention the detector member is made of plastic material in the form of a loop of stiff of flexible pipe which ruptures when it reaches a critical temperature. This form of the invention makes possible the utilization of a low-price detector member which in addition operates reliably. The laying of the detector member becomes an extremely simple matter, as for example in the form of a loop ranging all over the danger zone.

As a further preferred feature of the invention the detector member is provided with a test valve for checking its internal pressure and is connected with a pressure supply for maintaining the internal operating pressure within the member, while the sensor is placed between the pressure supply and the detector member.

Such a design of the invention will ensure that the internal operational pressure within the detector member is permanently kept at a constant level while it is furthermore possible to check the system during operation to see if the detector member is in fact still under its working pressure or if a non-detected leak has occurred at some point along it.

It is possible to have choke between the pressure supply and the sensor. This further development of the invention serves to ensure that there is in fact a sudden decrease in the internal pressure of the detector member when it opens. The choke prevents a swift flow of the fluid to make good the loss from the detector member so that reliable response of the sensor is ensured. This feature at the same time serves to make sure that the detector member is continuously in connection with the pressure supply via the choke so that any leaks in the detector member may be compensated for.

It is possible to have at least one check valve placed between the pressure supply and the sensor and allowing flow of fluid towards the detector member. This feature ensures that after failure of the pressure supply the device of the invention will still be operational because the internal pressure is maintained.

In order to check whether the system has responded at any time it is possible to have an indicator light. It is furthermore possible to have a readout for the actual internal pressure in the detector member so that leaks may be promptly noticed.

As a further preferred feature of the invention, between the pressure supply and the detector member it is possible to have a shut-off valve which closes the connection between the detector member and the pressure supply when the pressure goes to a value below the minumum pressure valve of the pressure supply, such valve operation being more especially brought about by operation of a pressure responsive switch upstream from the valve. Such a feature of the invention ensures that when there is a failure of the pressure supply, escape of fluid under pressure in the detector member is prevented. At the same time the pressure responsive switch may give an alarm signal.

The sensor and, if present, the check valve and the choke may be placed in a detector device. Two such detector devices may be placed on or in a block- or slab-like carrier of anodized aluminum so as to form a module-like surveillance unit therewith, which on the one hand is connected with the pressure supply and on the other hand may have detector members connected to it in a number the same as the number of detector devices.

In keeping with a further feature of the invention, the pressure supply and the detector member are adapted to be connected with the back panel of the carrier, which is in the form of a connection array, and then communicate with a supply duct and with pressure fluid ducts inside the carrier.

The topside of the carrier may be adapted to function as a component mounting facility having two component mounting areas for the detachable mounting of two sensors connected via a sensor duct in the interior of the carrier running from the sensor to a respective duct for fluid under pressure.

The fluid pressure ducts may be arranged to extend through the carrier, in the length direction thereof, to open at the front side of the carrier in respective female holes for a pressure checking gage.

The supply duct may extend in the length direction of the carrier between the two fluid ducts to open at a valve mounting area on the said component mounting facility, it being possible for a high speed charging valve to be detachably mounted on such valve area so that the said valve may communicate via a filling duct within the carrier with the two pressure ducts.

It is possible to have at least one check valve arranged in the charging duct which permits flow of fluid to the pressure ducts, and prevents it in the opposite direction, there being a separate check valve for each pressure duct.

The system may furthermore be so designed that the supply duct is connected directly with the pressure ducts via two branch supply ducts, provided with a check valve and/or a choke, and arranged at an angle to the length direction of the carrier and parallel to a top face thereof so as to be coaxial.

Furthermore branch supply ducts and branch ducts from the charging duct may open on the longitudinal sides of the carrier and be sealed by detachable sealing means, such ducts having larger diameters on the longitudinal sides so as to receive the check valves and chokes therein, which may be removed, as for example by unscrewing them.

The sensors may be L-like pressure sensitive switches, with one limb of the L-form carrying an electrical terminal from which the signals, produced when the pressure sensitive switch is actuated, may be taken. The other limb of the L-shape has a valve means and when the two switches are mounted the respective short limb of the one switch is adjacent the longer limb of the other switch.

In accordance with a further development of the invention, there is a panel of the front side of the carrier which has a push button switch for actuation of the high speed charging valve, an indicator light operated by a signal from the sensor and two pressure monitoring gages indicating the pressure in the pressure fluid ducts.

The system may furthermore be so designed that on the component mounting facility at the back side of the carrier there is an electrical circuit card connector which on the one hand is in communication with the sensors and the indicator light and on the other hand may be connected with an electrical controller responding to the signals from the pressure sensitive switches.

On the connection part of the carrier it is possible to have a central connection plug with continuous ducts provided with normally closed shut-off valves. This plug may be detached and its ducts communicate on the one hand with the pressure or supply ducts in the carrier and on the other hand may be connected with the ducts running to the pressure supply and to the detector members.

These further developments of the invention are characterized by a high degree of compactness so that large systems connected with a large number of detector members may be so built up that the state of the system may seen at a glance. A further useful effect of compactness is that connecting ducts or channels are short in length so that the device of the invention is very reliable and its components are placed close together. Even on a pressure supply failure lasting several days the system of the invention still remains operational. Its individual components employed are very robust, i.e. not easily damaged, so that the reliability of the system is increased. At the same time the individual components may readily be replaced, as for example if one should fail, and the system is readily serviced. It is more especially the above-mentioned development with a central plug which ensures that in the event of any replacement of one of the modular surveillance units being necessary, there will be no discharge of fluid from the supply ducts with a consequent loss of power. If a surveillance unit is removed the pressure supply and the supply ducts to the detector members are automatically sealed off. If then another surveillance unit is connected the system may become operational at once without delay, since one does not have to go to the trouble of charging the supply ducts with fluid, which would take some time. The device of the invention is further characterized by optimum availability of the system. In particular the feature involving the design of the carrier in the form of an aluminum block or slab makes it possible to avoid false alarms being given and owing to the redundant or duplicated arrangement of two detector members a main alarm is only raised when both of the detector devices indicate that there is a fall in pressure in the detector member.

Further details and features of the invention will be gathered from the following account of various embodiments thereof as shown in the drawings.

LIST OF THE SEVERAL VIEWS OF THE FIGURES

DETAILED ACCOUNT OF WORKING EXAMPLES OF THE INVENTION.

Figure 1:
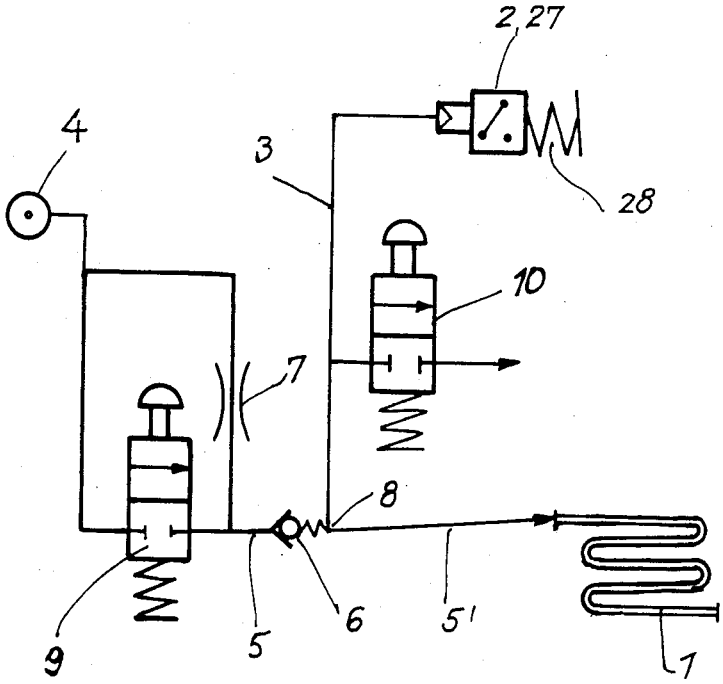
FIG. 1 is a schematic of the system in accordance with the present invention.

Referring initially to FIG. 1, the intention is to give a general account of the operation of the system in accordance with the invention. The operation is based on the principle that at a certain maximum or critical temperature in a room or in a component a certain effect is caused to take place. The device reacts to an absolute temperature of a body or to heat radiation. In the present working example the component, which starts a cycle of events on reaching a critical temperature, is in what follows to be termed the detector member, that in FIG. 1 is referenced 1. The detector member in the present case is a sealed hollow member which has a certain internal pressure and on reaching the critical temperature opens so that its interior is put in communication with the surroundings by an orifice and the pressure in the detector member becomes the same as the outside pressure of the air. This drop in pressure is sensed by a sensor 2 which is associated with the detector member 1, that is to say at this temperature the sensor produces a signal which may be processed. This signal is for example fed to an indicating unit, not shown, and furthermore may cause measures to be taken to reduce the temperature. If the device in accordance with the invention is used for fire surveillance, it would be appropriate to connect the sensor 2 with a sprinkler or other fire extinguishing installation.

It will furthermore be seen from FIG. 1 that the sensor 2 is connected via a duct 3 with the interior of the detector member 1. The detector member 1 may have various different configurations and particular possible advantages ones are described in more detail below.

With further reference to FIG. 1, it will be seen that the detector member 1 is connected with a pressure supply 4 to charge it with fluid, such as air, at a given pressure level. The connection between the pressure supply 4 and the detector member 1 is permanent so that any leakage losses will not mean that a constant pressure is not maintained in the detector member. However in order to keep the system in an operational condition despite a short-term or even protracted failure of the pressure supply 4, there is a check valve 6 in the supply duct 5 between the pressure supply 4 and the detector member 1. Such check valve allows the flow of fluid in the direction from the pressure supply 4 to the detector member 1 but prevents a flow in the opposite direction. It will be clear that the duct 3 to the sensor 2 may only be connected with the part 5' of the duct 5 between the check valve 6 and the detector member 1. The operational internal pressure will obtain in this part 5' even after failure of the pressure supply 4.

Between the pressure supply 4 and the detector member 1 there is a choke 7 which in terms of the direction of flow from the pressure supply 4 to the detector member 1 is upstream from the junction 8 for the sensor 2. The purpose of this choke 7 is to ensure a permanently open connection between the detector member 1 and the pressure supply 4 so that in the case of any leaks in the system as a whole the amount of escaping fluid may be made good with the sensor detecting any drop in the pressure of the fluid. Simultaneously with this however, the main function of the choke 7 is to cause a low rate of flow of the fluid even if there be a high pressure differential between the pressure supply 4 and the detector member 1 in order to assure a rapid and delay-free response of the sensor 2. If the intermediate choke 7 were not present it might in certain circumstances be possible for a drop in the detector member 1, caused by the opening of its orifice, to be compensated for by the simultaneous supply of fluid under pressure from the pressure supply 4, at least for a brief interval, so that at the sensor the drop in pressure would not be such that the sensor would respond thereto.

There is furthermore a high speed charging valve 9, placed in parallel to the choke 7, which is preferably in the form of a 2/2 way (two inputs/two outputs) valve and which is biased into a position in which it shuts off the supply of fluid under pressure. Thus, in this intial position the fluid under pressure flows via the part of the circuit having the choke 7 therein. If, for example on putting the system into operation for the first time or restarting, it it is desired to charge the detector member 1 as quickly as possible, operation of the high speed charging valve 9 will bypass the choke 7 so that the time needed for charging or filling will be reduced to a minimum.

Lastly there is also a test valve 10 which is connected with the interior of the detector member 1 (as for instance via the part 5' of the duct and the duct 3) and on the other hand with the surroundings. This test valve is as well preferably in the form of a 2/2 way valve, which is normally shut and with which it is possible to check to see if the detector member 1 is still completely sealed and is under pressure. For instance, in the event of the detector member 1 having a leak which is however not responded to by the sensor 2 owing to a failure, it is then possible to detect such irregular operation by actuation of the test valve 10. Preferably the sensor is directly connected with the detector member 1, although this is not shown.

In what follows a somewhat more elaborate form of the invention will now be described having reference to FIG. 2 which indicates how the system is mounted in structure. It will be seen that, in the ceiling 12 of a room 11, detector members 1 have been set, which in the present case are flexible detector ducts 13, whose one end is connected with the test valve 10 and whose other ends 17 are run into a distribution box 14. A duct 15, with a preferably copper armor or casing extends from this distributor box 14 to a protective housing 16 which is either itself resistant to fire and high temperatures or is accommodated so that it is resistant to fire and high there are supply ducts 18 placed in the armored duct 15, with a pressure-resistant flexible duct. These supply ducts 18 correspond in function to a part 5' of the duct 5 as in FIG. 1 and extend to surveillance units 22, which are to be described in what follows and which accommodate, generally speaking, the components shown in the schematic of FIG. 1, but naturally with the exception of the detector member 1 and the pressure supply 4. The supply of fluid under pressure to the surveillance units 22 is from a pressure accumulator or compressor or equivalent, via a feed duct 23, in which there is furthermore a shut-off valve 24 (preferably in the form of a 2/2 way solenoid valve) and a pressure responsive switch 26 acting on the solenoid 25 of the valve 24. The pressure responsive valve is so designed that when the pressure falls below a certain minimum in the feed duct 23 it sends a control signal to the solenoid 25 of the shut-off valve 24 so that same closes, it being a normally open valve. The pressure responsive switch 26 accordingly has the function of detecting any drop in the feed pressure coming from the pressure supply and of preventing further decrease by closing the shut-off valve 24 so that it is not possible for the supply ducts to the surveillance units 22, or even to the flexible detector ducts 13, to be vented. As a result even if the pressure supply fails the system in accordance with the invention will be fully operational for an extended period of time.

In what follows the reader will firstly be given a more detailed account of the flexible detector ducts 13. The flexible detector ducts 13 are fashioned of a material, as for instance plastic material of a certain composition, which fuses, bursts or fractures or the like at an "opening" temperature. If therefore the temperature at the ceiling 12 of the room 11 reaches this opening temperature, the interior of a flexible detector duct 13 is put into communication with the surroundings owing to such fusing or the like as noted. This leads to the drop in pressure as noted which in turn leads to actuation of a sensor 2 placed in one of the surveillance units 22.

Owing to the use of the above-mentioned flexible detector ducts 13, the costs of the materials and of the manufacture of the detector ducts 13 are very low, such flexible duct being readily available for instance in running lengths. Preferably, the flexible duct material is such that it may be laid in the form of loops as is indicated in FIG. 2. The operations for laying the flexible detector duct 13 are therefore very simple and time saving, while at the same time it is possible for large areas to be served so that a large room is not only served at certain points but rather all over large surfaces. The selection of the opening temperature for the flexible detector duct 13 may be made by a suitable choice of the duct material and the designer will utilize material with a higher or a lower fusing point in accordance with the desired sensitivity. Once the immediate vicinity of the flexible detector duct 13 has risen to a temperature near the fusing temperature of the duct, there will be a local softening of the duct wall whose strength will then no longer be sufficient to withstand the internal operating pressure. An internal operating pressure of approximately 7 bar has been found to give useful results.

At this juncture a short description will be given of the sensor 2. The same is preferably in the form of a pressure sensitive switch 27 which responds to a signal pressure which becomes established in the detector member 1 or the flexible detector duct 13. In accordance with FIG. 1 the pressure sensitive switch 27 is therefore acted upon in one direction by the internal operating pressure and in the opposite direction by a pressure spring internal operating pressure and in the opposite direction by a pressure spring 28. As long as the internal operating pressure is in existence in the detector member 1, the actuating force due to this pressure on the pressure responsive switch 27 overcomes the force of the pressure spring 28. If however there is a pressure drop in the detector member 1 so that its internal pressure goes down at least to the level of the signal pressure, the actuating force of the pressure spring 28 will be the overwhelming force and the pressure responsive switch 27 will be tripped.

Figure 2:
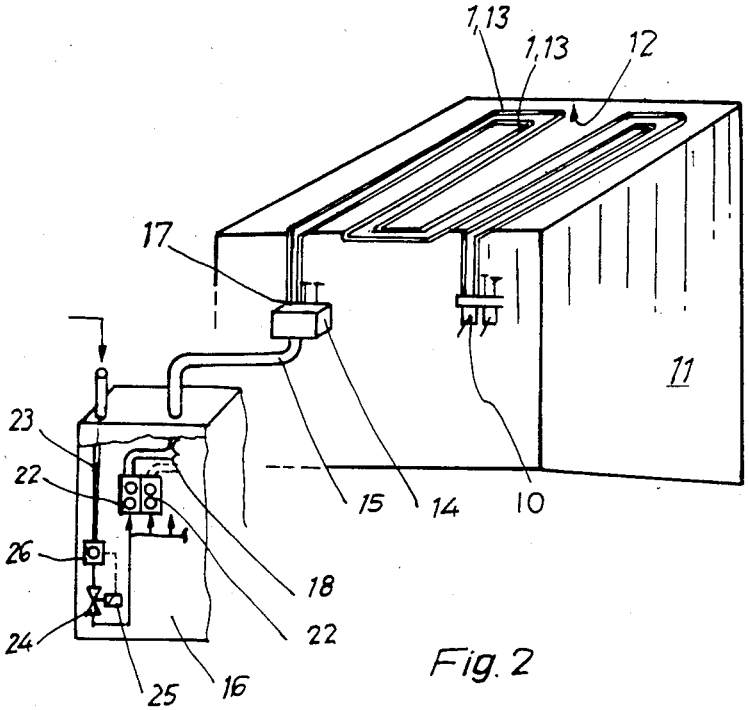
FIG. 2 shows an example of a fully installed system in keeping with the invention.

As will be seen from FIG. 2 the room indicated therein is surveilled by two flexible ducts 13 arranged in a double loop system. The two detector ducts 13 lead to a common surveillance unit 22, wherein the pressure signals as supplied from the ducts 13 may be processed or reacted to, as for example by causing a prealarm to be activated even if only one of the flexible detector ducts has opened and causing a main alarm to be raised only when both the ducts 13 have burst so that further operational cycles may be initiated as will be described in more detail below. The double loop system is therefore used to prevent a false alarm being given, as might otherwise be the case if a leak were to occur in only one duct 13 in single duct system.

Figure 3:
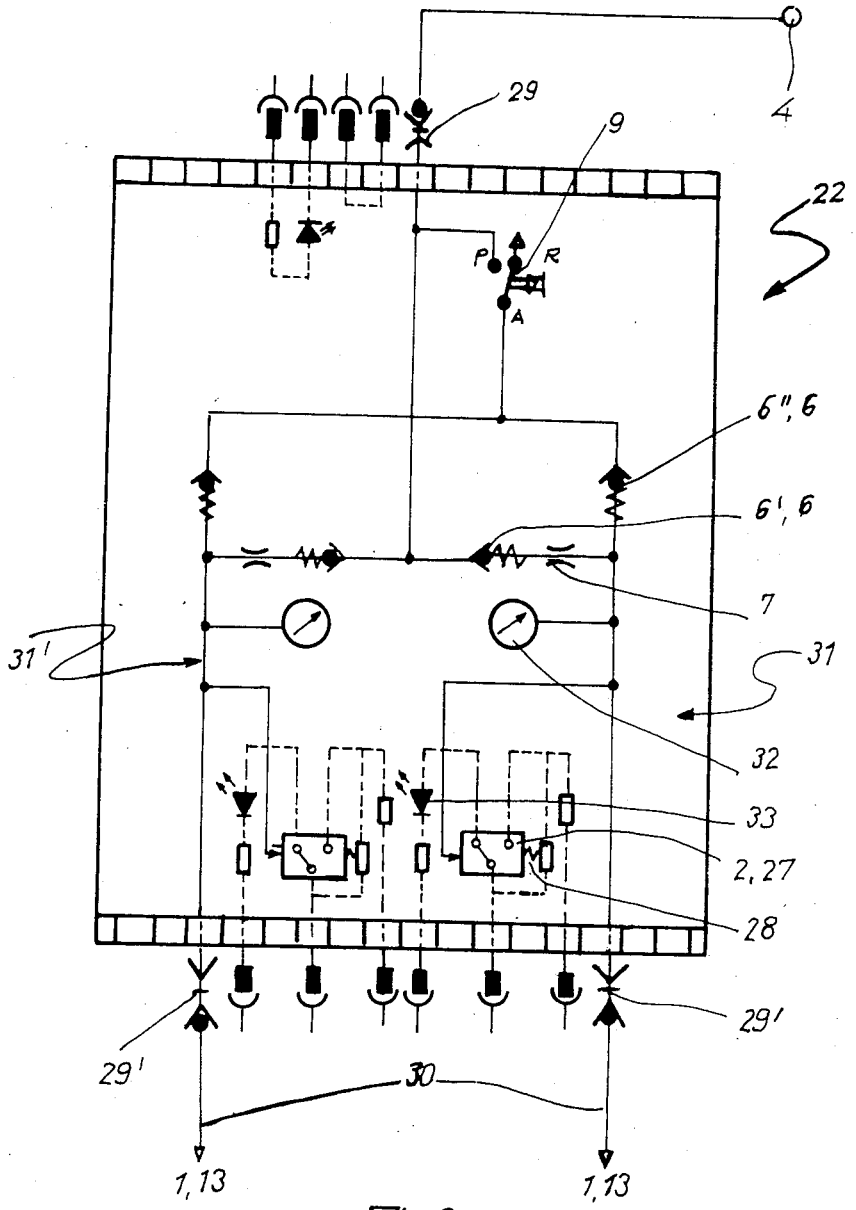
FIG. 3 is a circuit schematic of the system of the invention designed for the connection of two detector members. together with the schematic of the modular or building block surveillance unit.

In what follows an account will be given in more detail of one of the surveillance units with reference to FIG. 3. The reader will here be able to see a diagrammatic view of the unit with its pressure supply, which is connected via a terminal unit with the surveillance unit 22. There are furthermore the outputs 30 joined with two detector members 1 or detector ducts 13 (not shown) and also joined with the surveillance unit via connection units 29'. The main parts of the surveillance unit 22 are two detector devices 31 and 31' which each comprise the sensor 2, the choke 7, the check valves 6 as described with reference to FIG. 1, and furthermore a pressure monitoring gauge 32 and an indicator light 33. For the sake of simplicity these components are only illustrated in FIG. 3 in the case of one of the detector devices 31 and the second detector device 31' is identical thereto and fitted with the same components. The high speed charging valve 9 serves the two detector devices 31 and 31' in common and when actuated supplies them with a fluid under pressure.

The manner of operation of each of the two detector devices 31 and 31' is identical to the manner of operation described with reference to FIG. 1 so that no detailed account thereof is needed. With respect to the check valve 6 it is to be noted in addition that in order to ensure a compact construction of the surveillance unit 22 it is placed further downstream towards the pressure supply 4 than was the case in FIG. 1 so that the valve is embodied in the form of two check valves 6' and 6'' which are placed on a pressure duct with the high speed charging valve 9 and in the pressure duct with the choke 7 therein. However there is no change in the design of the two check valves.

The pressure monitoring gauge 32 is connected with the interior of the detector member 1 so that the internal pressure of the detector member may be visually checked. It is best for the connection of the pressure monitoring gauge 32 to be between the detector member 1 and the check valves 6' and 6'', this also applying for the connection of the sensor 2 in the form of a pressure sensitive switch 27. Furthermore the sensor 2 is electrically connected with the indicator light 33 which is turned on, on actuation of the sensor, 2 by an electrical signal from the sensor. The indicator light 33 is preferably an LED.

The manner of operation of the surveillance unit 22 will now be explained with reference to FIGS. 2 and 3. The two flexible detector ducts 13, located on the ceiling 12 of the room, are connected with the surveillance unit 22 in the protective housing 16 via the connection units 29'. For each detector duct 13 there is separate surveillance by one of the two detector devices 31 and 31'. As soon as one of the two detector ducts 13 is damaged or destroyed and therefore opened when there is a fire in the room and it becomes so hot that the "opening temperature" is reached, there will be a pressure drop in the "line" between the choke 7 and the corresponding detector duct 13 and such drop will activate the respective pressure sensitive switch 27, which will then generate a prealarm signal causing, among other things, the turning on of the indicator light 33 of the respective detector device. If the second detector duct 13 is now damaged so that it opens, i. e. bursts, the second detector device will respond in the same way and the main alarm will now be raised or given. The main alarm may for example cause the activation of an automatic fire extinguishing system. Owing to the duplication of the detector ducts 13 and the detector devices 31 and 31', spurious raising of the alarm is practically out of the question and it is only the bursting of both the detector ducts 13 so as to be open at the same time that causes the main alarm to be raised.

If during operation the pressure supply 4 should fail, the check valves 6' and 6'' prevent a drop of pressure in the detector hoses so that the system will still be operational and it will be possible for the supply of pressure to be put into operation again.

The detailed design of a surveillance unit 22 will now be gone into on the basis of the FIGS. 4 through 8. The unit comprises a carrier 34 in the form of a block or slab, i. e. with the form of a rectangular prism, which has ducts running through it, for connection with the individual detector devices, so that the surveillance unit 22 has a modular form. The back side 35 of the carrier 34, which in the present case is in the form of a rectangular block, serves as a connection facility, which possesses a supply connector 36 for the connection of a pressure supply and two detector member connectors 37 for connection to two detector members 1. The connectors 36 and 37 project from the back side 35 and are arranged in a single plane parallel to the topside 38. The supply connector 36 is in communication with a supply duct 42 formed in the interior of the carrier, whereas the detector member connectors 37 are each joined with a feed duct 43 and 43', respectively. All these three ducts run through the carriers 34 in the longitudinal direction thereof, the supply duct 42 being in each case placed between two feed ducts 43 and 43'. The feed ducts 43 and 43' terminate within the interior of the carrier 34 a small distance short of the front side 44 of the carrier 34 where they open in each case in the side of a socket hole 45, forming a blind hole extending into the front side 44 of the carrier, for pressure monitoring gauges 32 (see FIG. 6).

The topside 38 arranged at a right angle to the back side 35 of the carrier 34 is designed as a component mounting facility or area 46 and 47 respectively, on which sensors in the form of pressure sensitive switches 27 are detachably secured, as for example using screw means as marked at 48. A respective sensor duct 69, marked in broken lines, opens at each such component mounting area 46 and 47, the one sensor duct being connected with the first feed ducts 43 and the other sensor duct being communication with the second feed duct 43'. Each of the two sensors or switches 27 is therefore joined with one of the two feed ducts 43 and 43'. It is most convenient if the two sensor ducts run at a right angle to the topside 38 of the carrier and also open at a right angle into the feed duct 43 and 43'.

The supply duct 42, whose configuration will be described in more detail below, opens at the front side 44 of the carrier in a valve mounting area or facility 49 forming part of the component mounting facility of the topside 38 of the carrier on which the high speed charging or filling valve 9 is detachably mounted. There is furthermore a charging duct 50 extending in the interior of the carrier 34 which communicates with each of the feed ducts 43 and 43' and further opens at the valve mounting area 49. The high speed charging valve 9 is in the form of a 2/2 way valve and is normally closed so that in its non-actuated condition it interrupts the connection betwixt the supply duct 42 and the charging duct 50, whereas, when actuated, said valve joins these two ducts together.

The said charging duct 50 also extends between and parallel to the two feed ducts 43 and 43' and first extends at a right angle from the valve mounting area 49 (see FIG. 8) and at the level of the feed ducts (at 51) it turns and runs in a plane share with such feed ducts. From this point there branch two coaxial charging ducts 52 and 52' which run at a right angle from the charging duct 50 so as to be approximately coplanar with the feed ducts. These branch ducts 52 and 52' are respectively joined with one of the feed ducts 43 and 43'. Each of the branch charging ducts 52 and 52' contains a check valve 6'' which permits flow from the charging duct 50 into the respective one of the feed ducts 43 and 43' and prevents reverse flow in the contrary direction, see FIG. 6.

By way of the two coaxial branch supply of connecting ducts 53 and 53' which are at a right angle to the longitudinal direction of the carrier and are parallel to its topside 38, the supply duct 42 is connected with each of the two feed ducts 43 and 43' directly. In each of the branch supply ducts 53 and 53' there is a choke 7 and a check valve 6'. The check valves are designed to prevent flow from the feed ducts to the supply duct 42.

Figure 6:
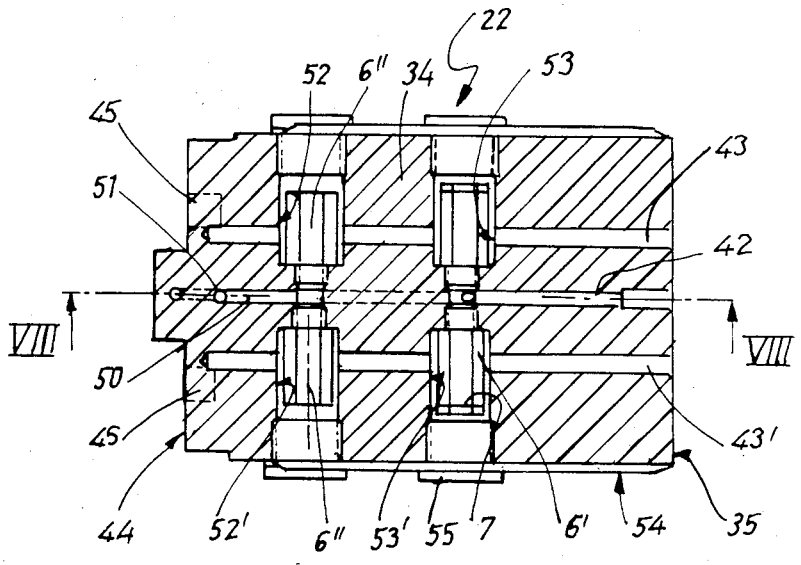
FIG. 6 is a section of the modular surveillance unit as taken on the line VI—VI of FIG. 4.

On inspection of the plan view of FIG. 6 looking down on the carrier, it will be seen that the coaxial branch charging ducts 52 and 52' and the branch supply ducts 53 and 53' are parallel to each other and run transversely in relation to the longitudinal direction of the carrier. In order to facilitate mounting of the check valves, both the branch charging ducts 52 and 52' and also the branch supply ducts 53 and 53' are drilled right the way through the carrier so that in each case one branch charging and one branch supply duct opens on one of the long sides 54 of the carrier 34. At their ports in these sides the branch ducts are made with a larger diameter and are provided adjacent to the charging and supply ducts 50 and 42 respectively with a screw thread so that the check valves 6' and 6'' may be screwed into the widened ports as inserted components and are completely within them so as to be within the plane of the surface. The ports of the branch ducts 52, 52', 53 and 53' are sealed off by plugs 55 in the long side 54. The choke 7 has the shape of a plug and is screwed onto the respective check valve 6'.

Figure 8:
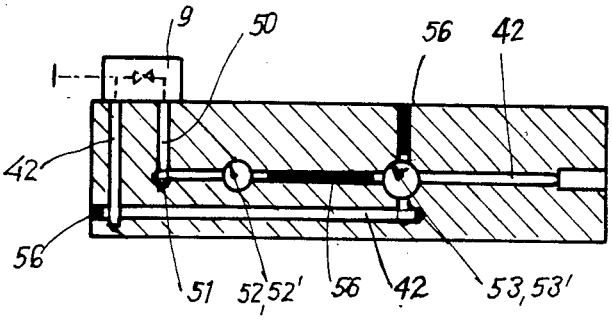
FIG. 8 is a section through the modular surveillance unit as taken on the line VIII—VIII of FIG. 6.

FIG. 8 is a detailed view showing the configuration of the supply duct 42 and of the charging duct 50, the parts 56 marked in solid black being plugged. Such parts of the ducts are first drilled in order to simplify production and are then filled up later.

Figure 7:
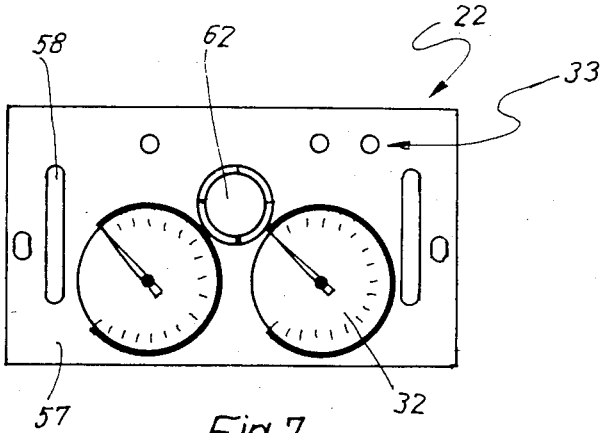
FIG. 7 shows the modular surveillance unit from the front.

FIG. 7 is a front view of the surveillance unit 22 so that the reader will be able to see a rectangular front panel 57, two grips 58 for insertion of the unit into a rack or the like, a pressure monitoring gauge 32, a pressure switch 62 for operation of the high speed charging valve 9 and an indicator light 33 in the form of an LED. The pressure monitoring gauges 32 have their connections 63 screwed air-tightly into the respective socket holes 45. The pressure switch 62 is connected via an extension plunger 64 with the valve member (not shown) of the high speed charging valve 9, see FIGS. 5. As will be seen from FIG. 4, the front panel 57 itself is connected via two spacers 65 with the carrier 34. In the plan view of FIG. 5 it will be seen that the spacers 65 are bent into the shape of a letter L, the short limb 66 of the L resting on the back side of the front panel over a large area and fixed thereon by means of the attachment screws belonging to the grips 58. The longer L limb 67 of the spacers 65 stretches in the length direction of the carrier 34 and is screwed to the side thereof as marked at 61 in FIG. 4.

Owing to the provision of the pressure ducts inside the body of the carrier 34, there is the useful effect that no external connecting ducts for the fluid under pressure are needed. And the sensors in the form of the pressure sensitive switches 27 may be detachably mounted right on the topside 38 of the carrier in the component mounting area 47 so that the switching member thereof is connected with an internal duct 68, marked in broken lines, leading to one of the sensor ducts (at 69) which itself leads to the one of the feed ducts 43 and 43'. The pressure sensitive switches themselves 27 have an essentially L-like form, the longer limb thereof forming a rectangular block-like pressure sensitive switch housing 70 containing a valve means, whereas the short limb of the L-form carries an electrical connection means 71 bearing pins 72 on which tabs may be crimped for the transfer of electrical signals from such pins 72 as produced when one of the pressure sensitive switches 27 actuates.

After mounting on the component mounting areas 47 the longitudinal axes 73 of the pressure sensitive switch housings 70 run parallel to the back side 35 of the carrier and a right angle to the longitudinal axis 74 of the carrier. Thus the two pressure sensitive switch housings 70 are offset in parallelism to each other, the electrical connection means 71 of the pressure sensitive switch 27 on the front panel 57 facing towards the back side 35 of the carrier while the electrical connection device of the pressure sensitive switch 27 on the back side 35 faces towards the front panel 57. At the same time the electrical connection device of the one pressure sensitive switch is turned towards the free end of the longer L-limb, forming the pressure sensitive switch housing 70, of the other pressure sensitive switch, so that in other words the two electrical connection means 71 are turned in opposite directions while being parallel to each other and the longitudinal axis 74 of the carrier. Accordingly as viewed in the plan view of FIG. 5 it will be seen that there is a generally rectangular overall outline of the "unit" constituted by the two pressure sensitive switches 27.

Figure 4:
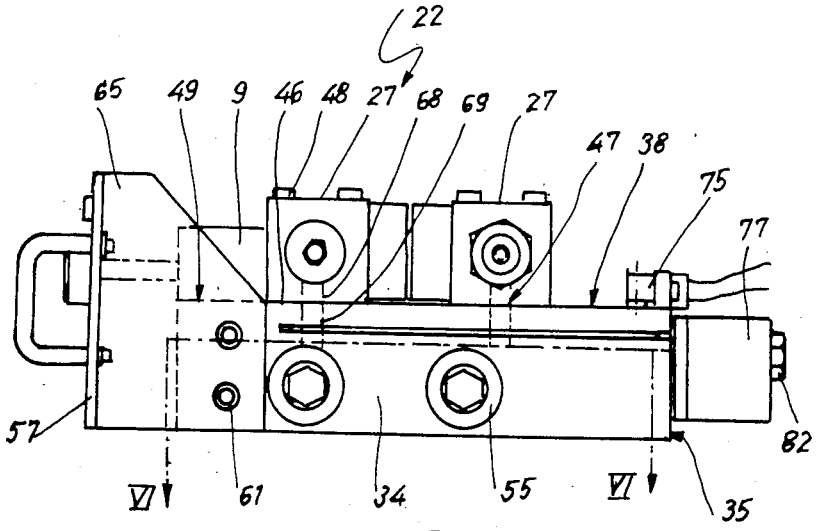
FIG. 4 represents a side view of the modular surveillance unit.
Figure 5:
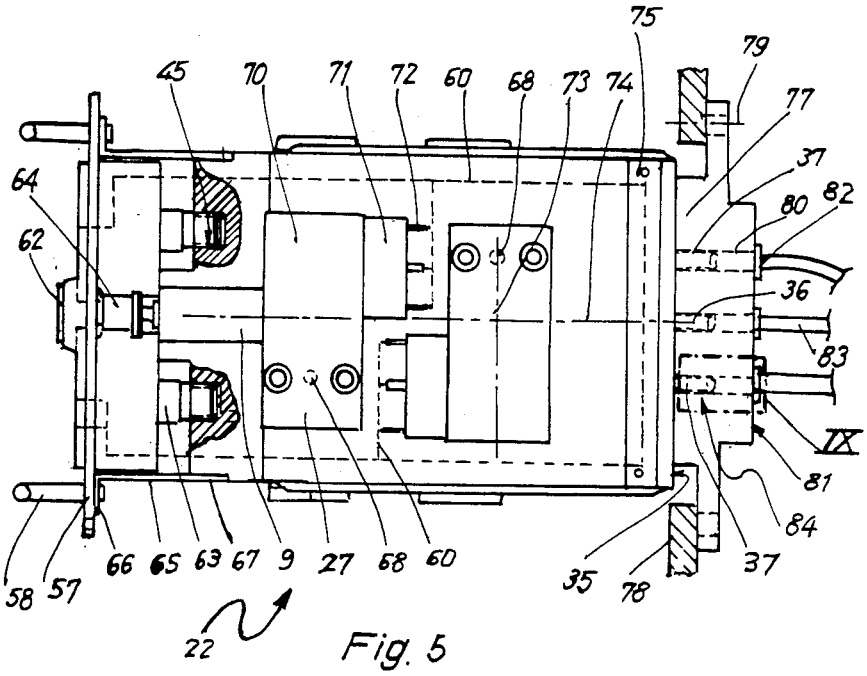
FIG. 5 is a view looking down onto the modular surveillance unit.

Referring now to FIGS. 4 and 5, it will be seen that on the component mounting facility of the topside 38 adjacent to the back side 35 of the carrier 34 there is a circuit card connector 75 that is arranged so as to be parallel to the said back side. This connector 75 is on the one hand electrically connected with the pressure sensitive switched 27 and the indicator lights 33 (as marked by the broken lines 60 in FIG. 5) and on the other hand is able to be joined up with an electrical unit, not shown for processing signals from the pressure sensitive switches.

Figure 10:
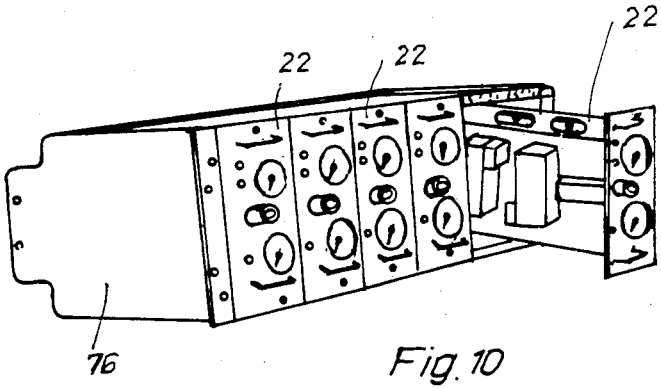
FIG. 10 shows a number of modular surveillance units as part of a monitoring or surveillance system.

The modular form of the surveillance unit 22 offers the especial advantage that a plurality of such surveillance units may be compactly arranged in a very small space. As will be seen from FIG. 10 the units are best accommodated in a rack 76 in the form of drawers that are parallel to each other. FIG. 10 serves to indicate a state in which the rack 76 has four fully inserted surveillance units 22 in it and a further, fifth surveillance unit 22 is just in the process of being inserted into or withdrawn from the rack. It is an advantage if in such an arrangement, there is further stationary bar-like connector, not shown, to the rear of the rack so that on inserting a unit into the rack 76 a connection is automatically produced between the card connector 75 and the bar-like connector. The temporary removal or the replacement of the surveillance units 22 may therefore be accomplished without manipulation of wiring using one' s fingers.

In order to be able to withdraw one of the surveillance units 22 from a rack or cabinet 76 of the type shown in FIG. 10 without manipulation of the pressure hose, there is a central connection plug 77 (shown in more detail in FIGS. 4 and 5) for each surveillance unit 22. This plug 77 has ducts extending through it and is designed to cooperate with the connectors 36 and 37 placed on the carrier when a surveillance unit 22 is pushed into place. In FIG. 5 the back wall of the rack 76 is shown diagrammatically at 78 and it has the connection plug 77 detachably mounted on it, as for example by screws marked at 79. Between the connectors 36 and 37 and the central connection plug 77 there is a plug connection, i.e. a connection with male and female elements, so that on withdrawal of the surveillance unit 22 or replacing it in the rack 76 the connection is automatically broken and remade respectively. Each of the connectors 36 and 37 is associated with a duct 80 running it in the rack 76 the connection is automatically broken and remade respectively. Each of the connectors 36 and 37 is associated with a duct 80 running through the connection plug, in which a screwed connection member 82 is screwed in from the back side 81 of the plug 77, which carries a flexible pressure duct 83, same forming the supply ducts for the supply of fluid under pressure to the detector members.

In order to keep up the fluid under pressure in the pressurized fluid ducts 83, the detector members and the means for pressure supply when a surveillance unit 22 is removed, the ducts 80 in the connection plug 77 are provided with valves 84 which, on withdrawal of the carrier automatically shut off the supply lines (pressure ducts 83) and which are opened by the mechanical action of these connection plugs when the connection plugs or connectors 36 and 37 are in their inserted condition. One of these shut off valves 84 will now be described in more detail with reference to FIG. 9.

Figure 9:
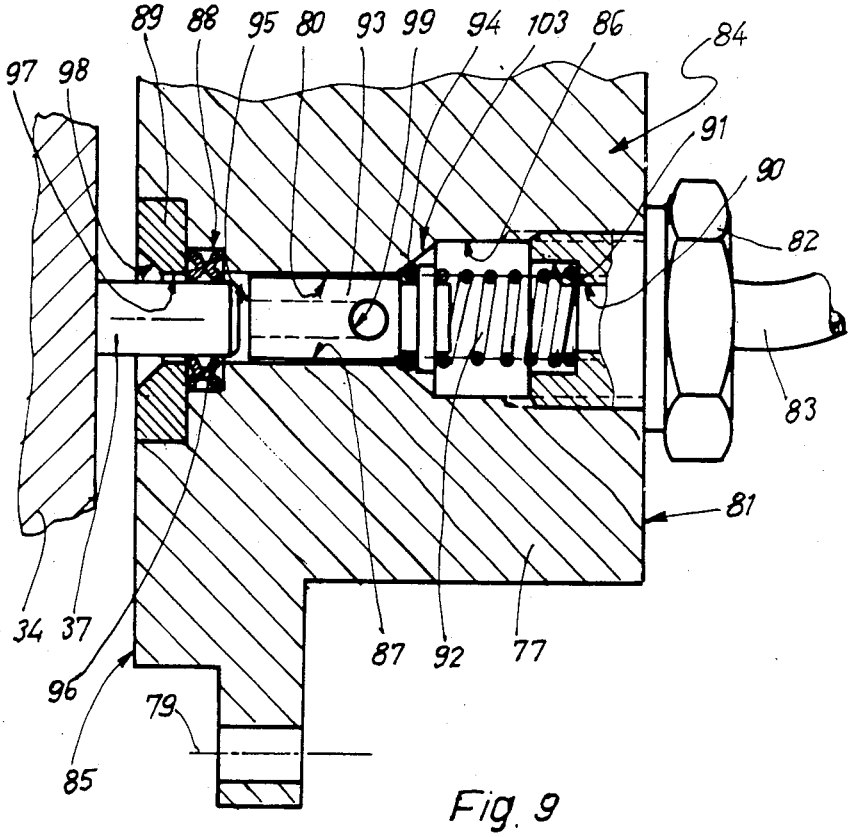
FIG. 9 is a sectional view of a connection plug as at IX in FIG. 5 on a larger scale.

FIG. 9 is a section of the connection plug 77 and the duct 80 running through it. Furthermore the rear part of a carrier 34 with connectors 37 for detector members is to be seen in a state in which they are half plugged into the duct 80. The diameter of the duct 80 is stepped, it having a cylindrical wider part 86 adjacent to the rear side 81. This wider part adjoins a duct part 87 with a smaller diameter functioning as a valve guide and followed by an annular wider part 88, which for its part merges into a further wider part in which a guide bushing 89 is set. The wider part 86 is threaded for some of its length starting from its outer so that the screw threaded connection member 82 may be received therein. The member 82 has a duct 90 running through it from end to end which at the inner end of the wider part 86 has a wider diameter socket 91 to accommodate a pressure spring 92. The same extends in the axial direction through the duct 80 so that its one end is located in the socket 91 while its other end contacts a cylindrical valve member 93 sliding longitudinally in the duct part 87. Furthermore part of this valve member is received in the wider part 86 and has an annular seal ring thereon mounted in a circumferential groove. The annular seal or packing 94 is urged by the spring 92 onto a valve seat 103 formed by a shoulder marking the adjacent ends of the wider part 86 and the duct part 87. Therefore, in the initial position in which the duct 80 is sealed by the annular packing 94, the valve member 93 extends axially through the duct part 87 in such a way that its end face 95 remote from the carrier 34 is at some distance from the front side 85 of the plug 77, this distance being less than the axial length of the connector 37. A packing ring 96 is mounted in the annular wider part 88 of the duct and its inner face makes sealing contact with the outer face of the inserted connector 37. It has been found to be a particular advantage in this respect if the packing ring 96 is made with a clover-leaf cross section. The guide bushing 89 has a central hole 97 with a diameter generally equal to that of the duct part 87 so that the packing ring 96 is retained and unable to slip out of the annular wider part 88. Towards the front side 85 the central hole 97 has a conically flared part 98 to facilitate insertion of the connector 37. With respect to the valve member 93, it remains to be added that it has a through hole 99 with one end in the end face 95 and with the other in the circumferential face of the valve member 93 on the side of the annular packing 94 nearer the front side 85. The manner of operation of the shut off valve 84 will now be explained.

Assuming that the surveillance unit, and with it the connector 37, has been detached from the connection plug 77, the duct 80 will be sealed off by the sealing parts 94 and 103 and it will not be possible for fluid in the flexible duct 83 to escape. On mounting the surveillance unit 22, the connector 37 will be inserted from the front side 85 into the duct 80 and at the same time it will displace the valve member 93 against the force of the spring 92. The annular packing 94 will come clear of the valve seat 103 and the fluid may then flow unhindered through the passage 99. Removal of the surveillance unit 22 will cause immediate closing of the duct 80.

With respect to the carrier 34 it is to be further explained that it is preferably made of solid aluminum so that it may readily be machined and has a low weight. It is given an anodized finish.

Referring to FIG. 8 it is to be noted in addition to what has already been said that the supply duct (42) has an angled or bent form so that starting at the connection part at the rear side (35) of the carrier and extending as far as the point of branching of the branch supply ducts (53 and 53') it is coplanar with the feed ducts (43 and 43') and after this point it extends in a plane which is parallel to this plane and is offset towards the lower side of the carrier (34) which is opposed to the topside (38) of the carrier (34).

We claim:

1. A surveillance system in the form of a pneumatic circuit designed for monitoring the temperature of an object and providing at least one signal when said object attains a critical temperature, said system comprising a detector member placed for sensing the temperature of said object, said detector member having a cavity therein, a pressure supply means for pressurizing this cavity of said detector member with air, said detector member being adapted to open on reaching said critical temperature to release air from it into the surroundings, a sensor connected with said cavity in said detector member and adapted to respond to a pressure drop in said cavity on the opening of said detector member and to produce a response signal, said pressure supply means being provided for pressurizing said cavity, a pressure testing valve for monitoring the internal pressure of said cavity, a duct connected with said pressure supply means and with said detector member at two respective connection points, said sensor being connected at a point between said two points, a choke placed on said duct between said sensor and said pressure supply means, at least one check valve placed between said pressure supply means and said sensor, said check valve being adapted to permit air flow towards said detector member, further comprising a prismatic aluminium carrier with at least two such sensors mounted thereon to form a modular surveillance unit adapted to be connected on the one hand with said pressure supply means and on the other hand with a number of detector members equal to the number of sensors.

2. The surveillance system as claimed in claim 1, wherein said carrier has a rear side adapted to be connected with said pressure supply means and said detector members for communication with supply and feed ducts formed in said aluminum carrier.

3. The surveillance system as claimed in claim 2 wherein a topside of said carrier is adapted for use as a component mounting facility for the detachable mounting thereon of two such sensors on two mounting areas thereon so as to communicate pneumatically with respective sensor ducts in said carrier in one of such mounting areas and to communicate with a feed duct in said carrier in the other said mounting area.

4. The surveillance system as claimed in claim 3 wherein said feed ducts extend through said carrier in the length direction thereof and at a front side thereof open into respective sockets adapted to receive pressure monitoring gauges.

5. The surveillance system as claimed in claim 4 having two such feed ducts extending in the length direction of said carrier and further a supply duct extending parallel to and between said feed ducts to end at the front side of said carrier in a valve mounting area of said component mount facility, said system further comprising a high speed charging valve detachably mounted on said valve mounting facility for joining to a charging duct in the interior of said carrier and able to communicate with said two feed ducts.

6. The surveillance system as claimed in claim 5 comprising at least one check valve mounted in said charging duct to permit flow to said feed ducts while preventing flow in the opposite direction.

7. The surveillance system as claimed in claim 6 comprising one check valve for cooperation with each such feed duct.

8. The surveillance system as claimed in claim 6 having two branch supply ducts formed in said carrier at a right angle to the length direction of said carrier so as to be parallel to the topside thereof and connected by flow control means directly with said feed ducts.

9. The surveillance system as claimed in claim 8 wherein said flow control means includes a check valve.

10. The surveillance system as claimed in claim 8 wherein said flow control means includes a choke.

11. The surveillance system as claimed in claim 8 wherein said branch ducts of said charging duct and said branch supply ducts open at ports in long sides of said carrier and are sealed by removable sealing means and said ports have a larger diameter than said branch ducts, said ports being adapted to releasably receive flow control means.

12. The surveillance system as claimed in claim 6 comprising a front panel on said front side of said carrier, a pressure switch on said panel for actuating said high speed charging valve, an indicating light means on said panel for displaying a signal from said sensor and two pressure monitoring gauges on said panel.

13. The surveillance system as claimed in claim 3 wherein said sensors comprise pressure sensitive switches each with two limbs of different length placed at a right angle to each other, one such limb bearing electrical connection means for output of signals as produced on actuation of said pressure sensitive switch, said other limb comprising valve means of said respective sensor, said limbs being so mounted on said carrier that they form a rectangle with the shorter limbs parallel to each other and with the longer limbs parallel to each other.

14. The surveillance system as claimed in claim 3 comprising an electrical connector mounted on said mounting facility adjacent the rear side of the carrier and parallel thereto, said electrical connector being joined on the one hand with such sensors and with an indicating light and being adapted for connection with an electrical control unit for processing signals from said sensors.

15. The surveillance system as claimed in claim 14 comprising a central connection plug detachably joined to a connection part of said carrier, said plug being joined with continuous ducts in said carrier which are able to communicate with said feed and supply ducts in the said carrier and with ducts for the supply of pressure and leading to the detector members.

16. The surveillance system as claimed in claim 14 comprising shut-off valves in the said continuous ducts and adapted to be overriden.

17. A surveillance system in the form of a pneumatic circuit designed for monitoring the temperature of a building area, comprising a slab-shaped carrier having one supply duct and two feed ducts therein, a hollow detector member connected to each feed duct, each detector member being structured to rupture upon the occurrence of a critical temperature and defining a hollow interior space for receiving a pressurized medium which is released to the surrounding when the detector member ruptures, pressure supply means connected to said supply duct for supplying said pressurized medium to said supply duct, a connecting duct connected between said supply duct and each of said feed ducts, a choke in each connecting duct for choking a flow of pressure medium from said supply duct to each of said feed ducts, a check valve in each connecting duct for permitting flow of pressurized medium only from said supply duct to each of said feed ducts, a sensor duct connected to each of said feed ducts, and a sensor connected to each of said sensor ducts for sensing a drop in the pressure of said pressurized medium in each feed duct and for generating a signal upon the occurrence of the drop in pressure, whereby with pressurized medium being supplied by said pressure duct through said check valve and said choke, said feed ducts maintain a pressure of pressurized medium and, upon failure of said pressure supply means, the pressure in said feed ducts are maintained by said check valves, said slab-like carrier forming a modular unit carrying said sensors, check valves and choke, said pressure supply means and said detector members extending outside of said carrier and being connected to said carrier.

18. A surveillance system according to claim 17 wherein said slab-like carrier is made of aluminum.

19. A surveillance system in the form of a pneumatic circuit designed for monitoring the temperature of an object and providing at least one signal when said object attains a critical temperature, said system comprising a detector member placed for sensing the temperature of said object, said detector member having a cavity therein, pressure supply means for pressurizing this cavity of said detector member with air, said detector member being adapted to open on reaching said critical temperature to release air from it into the surroundings, a sensor connected with said cavity in said detector member and adapted to respond to a pressure drop in said cavity on the opening of said detector member and to produce a response signal, a shut-off valve placed between said pressure supply means and said detector member, said shut-off valve being adapted to automatically shut off said pressure supply means from said detector member when the pressure supplied by said pressure supply means falls below a given valve.

20. The surveillance system as claimed in claim 19 further comprising a pressure sensitive means adapted to respond to the pressure supplied by said supply means and to cause said shut-off valve to close when said pressure falls below said given value.

* * * * *